United States Patent [19]

Lengacher

[11] 4,399,496

[45] Aug. 16, 1983

[54] BATTERY POWERED LAMP DEVICE

[76] Inventor: Eli Lengacher, Rte. 3, Box 559, Grabill, Ind. 46741

[21] Appl. No.: 341,591

[22] Filed: Jan. 22, 1982

[51] Int. Cl.[3] ..... F21L 7/00

[52] U.S. Cl. ..... 362/203; 362/186; 362/205; 362/206; 200/60

[58] Field of Search ..... 200/60; 362/203, 186, 362/205, 206

[56] References Cited

U.S. PATENT DOCUMENTS

| | | | |
|---|---|---|---|
| 1,649,882 | 11/1927 | Wolcott | 362/203 |
| 3,355,582 | 11/1967 | Swee | 362/203 |
| 4,187,532 | 2/1980 | Naffier | 362/186 |
| 4,303,970 | 12/1981 | Robertson | 362/203 |

*Primary Examiner*—Stephen J. Lechert, Jr.
*Attorney, Agent, or Firm*—George A. Gust

[57] ABSTRACT

This invention relates to a battery powered lamp device which includes an upright base of metal, a bulb and switch-retaining member of metal and an upright chimney. The member has lower and upper ends and is mounted on the upper end of the base. The chimney is mounted on the upper end of the member. The base is provided with an upright elongated battery-receiving cavity closed at its bottom and open at its top. The aforesaid member is provided with a bore which is in registry with and constitutes an extension of the cavity. A bulb provided with a base having a central contact is mounted on said member and within the bore in such a manner that the illuminating portion of the bulb extends within the chimney. The base of the bulb is fitted into the upper portion of the bore for positioning the contact centrally thereof. A compression spring is disposed within the cavity in electrical contact with the bottom thereof. A battery within the cavity extends into the bore and at one end conductively engages the spring. The battery is further operatively engageable at the other end with the bulb contact. An electrical switch device on the member may be manually manipulated for moving the battery into and out of operative engagement with the bulb thereby to control the energization thereof.

13 Claims, 7 Drawing Figures

BATTERY POWERED LAMP DEVICE

BACKGROUND OF THE INVENTION

1. Field of the Invention

The present invention relates to battery powered lamp devices and more particularly to such lamp devices energized by means of a battery or dry cell. The ornamental design of this invention is the subject of a copending application for design patent.

2. Description of the Prior Art

Battery powered lamp devices are well known, a common variety being flashlights. Flashlights are adapted to utilize one or more dry cells connected in either series or parallel and are manually operated by means of simple slide or push button switches.

SUMMARY OF THE INVENTION

This invention relates to a battery powered lamp device which includes an upright base of metal, a bulb and switch-retaining member of metal and an upright chimney. The member is provided with lower and upper ends and is mounted on the upper end of the base. The chimney is mounted on the upper end of the member. The base is provided with an upright elongated receiving cavity which is closed at its bottom and open at its top. The member is provided with a bore in registry with an constituting an extension of the cavity. A lightbulb is mounted on said member with the center contact thereof inside the bore, the base of the bulb being conductively engaged with the upper portion of the member. This positions the center contact centrally of the bore. A compression contact spring is disposed within the cavity in electrical contact with the bottom thereof. A battery disposed within the bore engages the spring which urges the battery toward engagement with the center contact of the bulb. An electrical switch means on the member may be operated for controlling engagement of the battery with and energization of the bulb.

The aforesaid spring is preferably helical and engages the shell or negative electrode of the battery at one end. The switch means includes a manually operable switch element threaded into the member for movement transversely with respect to the cavity. The switch element is provided with a cam portion on its inner end which operatively engages an upper edge portion of the battery or dry cell whereby rotation of the switch element in one direction forces the battery downwardly thereby to disengage the battery from the bulb contact and in the other direction permits the battery to move upwardly under the force of the spring to engage the bulb contact.

The cam portion on the switch element preferably is in the form of a conical tip on the end of the switch element.

It is an object of this invention to provide a lamp device which is simple in design, economical to manufacture and reliable in operation.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
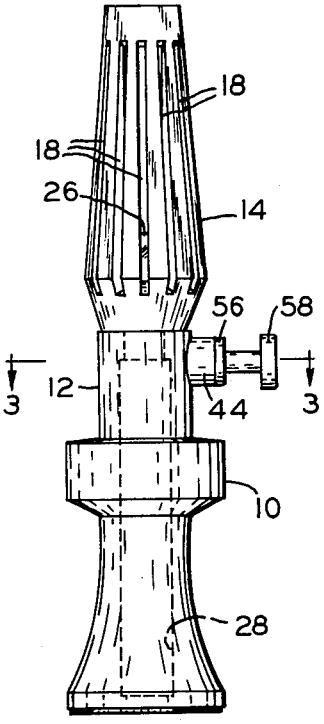
FIG. 1 is a side view of one embodiment of this invention.
Figure 2:
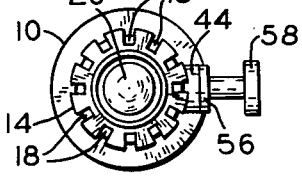
FIG. 2 is a top plan view thereof.

Referring to the drawings, the lamp device comprises a base 10, a bulb and switch-retaining member 12 and a chimney element 14. As shown more clearly in FIG. 6, the chimney element 14 is of tubular form and at its lower end is provided with female threads for fitting over the male threads 16 on the retaining member 12. The chimney 14 is provided with a series of longitudinally extending slots 18 for admitting light therethrough, the chimney otherwise being opaque.

The retaining member 12 is also tubular having male threads 16 on the upper end and male threads 18 on the lower end. Coaxially thereof, the retaining member 12 has a stepped diameter bore 20, the upper end thereof being internally threaded at 22 for receiving the threaded base 24 of a conventional flashlight bulb 26. The base 10 is generally cylindrical and is provided with an elongated cavity 28 of the same diameter as the larger diameter portion of the bore 40 in the retaining member 12. The upper end of the cavity 28 is internally threaded at 30 to receive threads 18 of the retaining member 12. The threads 16 and 18 and the counterpart threads on the chimney 14 and base 10 are preferably righthand.

A single penlight cell or battery 32 is slidably received within the cavity 28 with the positive or center electrode 34 uppermost. As is clearly shown in FIG. 6, the bore 20 in the retaining member 12 constitutes a coaxial extension of the cavity 28 and the battery 32 is slidably received in both.

Disposed in the bottom of the cavity 28 in coaxial relation therewith is a helical compression spring 36 which bears at one end against the bottom 38 of the cavity and its upper end against the bottom negative electrode or shell of the battery 32. The compression spring 36 is designed to yieldably urge the battery 32 upwardly to engage the positive electrode 34 of the battery 32 with the center contact 40 on the base of the lightbulb 26. By making the retaining member 12 and base 10 of metal, touching engagement of the positive battery electrode 34 with the lamp contact 40 serves to energize the lamp. Since the chimney or shade 14 is provided with a plurality of slot-like apertures 18, light from the bulb 26 will shine therethrough.

A manually operable switch device generally indicated by the numeral 42 is mounted on the retaining member 12 for turning the lamp 26 "on" and "off". This switch device 42 includes a cylindrical nut member 44 which is internally threaded, perferably with lefthand threads, which is fitted into a stepped diameter opening in retaining member 12 which extends transversely to the axis of the combined bore and cavity 20, 28. This opening includes stepped diameter bores 46 and 48, the outer diameter of the nut member 44 being substantially coincident with that of the larger bore portion 46. The nut member 44 is slidably inserted into the bore portion 46 until it engages the shoulder that is formed with the smaller bore portion 48. In order to secure the nut member 44 within the bore portion 46, suitable adhesive, such as a super glue or epoxy is used. Also, the nut member 44 may be press fitted into the bore portion 46.

Figure 6:
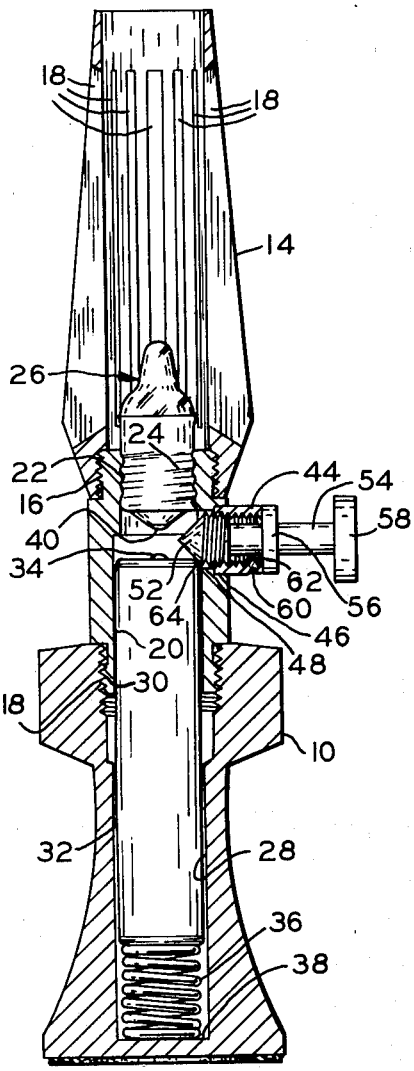
FIG. 6 is an axial sectional view of the lamp of FIG. 1.

Threadedly received by the nut member 44 is a switch element having a relatively short threaded portion 50 and a conically shaped camming portion 52 on the distal end. Extending oppositely from the threaded portion 50 is a stem 54 having an annular or disc portion 56 thereon which is of a diameter as to be engageable with the outer end of the nut member 44 as shown in FIG. 6. This portion 56 which otherwise may be considered as an abutment is spaced from the threaded portion 50. A further extension of the stem beyond the abutment 56 carries a disc or knob 58 by means of which the stem 54 and threaded portion 50 may be rotated.

Figure 3:
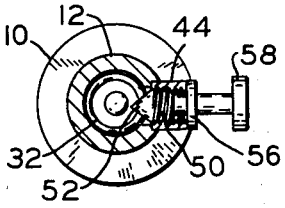
FIG. 3 is a cross section taken substantially along section line 3—3 of FIG. 1.

In order to retain the threaded portion 50 within the nut member 56, the nut member 44 is indented or swaged at 60 near the outer end to provide an inward projection 62 which serves as an obstruction to unthreading. This prevents the threaded portion from being withdrawn or unthreaded toward the right through the nut member 44 any farther than the position shown in FIG. 3.

The parts are so sized that by rotating the knob 58 in a direction to move the conical cam portion 52 inwardly of the bore 20 as far as it will go as determined by engagement of the abutment 56 with the righthand end of the nut member 44, the cam portion 52 will engage the edge 64 of the battery 32 adjacent the electrode 34 forcing the battery 32 downwardly against the bias of the spring 36. This causes the positive electrode 34 to disengage from the bulb contact 40. By rotating the knob 58 oppositely as far as it will go at which the point the threaded portion 50 engages the obstruction 62, the cam portion 52 will be withdrawn from the bore 20 a distance sufficient to allow the spring 36 to force the battery 32 upwardly until the positive electrode 34 engages the contact 40. Since the base 10, retaining member 12 and the chimney 14 are all of metal, an energizing circuit is established to the bulb 26 causing it to glow. Thus, when the abutment 56 is engaged with the righthand end of the nut member 44, the lamp 26 is deenergized and when the threaded portion 50 is moved outwardly until it engages the obstruction 62, the lamp 26 will be energized.

Figure 7:
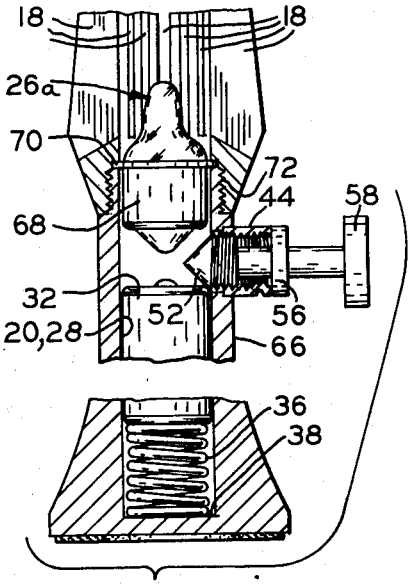
FIG. 7 is a view similar to FIG. 6 but of another embodiment of this invention.
Figure 4:
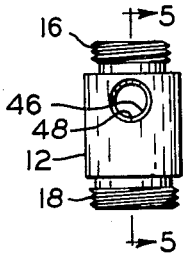
FIG. 4 is a side view of one of the elements of the lamp of FIG. 1 which is adapted to mount a bulb and also a manually operated switch.
Figure 5:
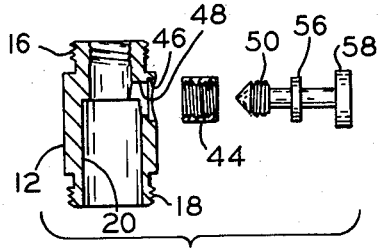
FIG. 5 is a sectional view partly exploded and taken substantially along section line 5—5 of FIG. 4.

An alternative embodiment is shown in FIG. 7 wherein the retaining member 12 as a separate part is omitted and is integrally combined with the base 10. The resulting member is indicated by numeral 66. In this embodiment, the lamp **26*a* does not have a screw base but instead is provided with a metallic, cylindrical base 68 having a radially outwardly extending contact flange 70. This contact flange 70 is squeezed or damped between the chimney 18 and the upper end of the base 66 when the two part are threaded together by means of the threaded connection 72. With the base 66 formed of metal, this provides a conductive path from the bottom end of the battery to the flange 70 of the lamp 26*a*. Otherwise, the embodiment of FIG. 7** is like that of the preceding figures.

It is possible to fabricate the parts 10, 12 and 14 of plastic. In this event, the cavity 28 in the bore 20 may be electroplated with a thin coating of metal such that when the two parts 10 and 12 are threaded together, a conductive path will be formed therebetween that extends to the bottom 38 and into the negative end of the battery 32 via spring 36. Alternatively, the plastic parts may be coated or plated internally and externally with metal. Still further, a ribbon of metal can be made to extend from the threads 22 through the bore 20 and cavity 28 into electrical contact with the bottom end of the spring 36. Thus, the present invention may be fabricated primarily of metal or plastic as may be desired. Also, in all of the embodiments, the chimney may be of plastic.

While there have been described above the principles of this invention in connection with specific apparatus, it is to be clearly understood that this description is made only by way of example and not as a limitation to the scope of the invention.

I claim:

1. A battery powered lamp device comprising an upright base of metal, a bulb and switch-retaining member of metal and an upright chimney, said member having lower and upper ends and being mounted on the upper end of said base, said chimney being mounted on the upper end of said member, a bulb having a base provided with an electrical contact, said base having an upright elongated battery receiving cavity closed at its bottom and open at its top, said member having an upright bore in registry with said cavity, said bulb being mounted within said bore to extend thereabove into the lower portion of said chimney, the base of said bulb being fitted into the upper portion of said bore for positioning said contact centrally of said bore, a compression contact spring within said cavity in electrical contact with the bottom thereof, a battery within said cavity extending into said bore and at one end engaging said spring and further being operatively engageable at the other end with said bulb contact, electrical switch means on said member for controlling the application of energizing voltage of said battery to said bulb, said spring being helical and urging said battery upwardly to engage said other battery end with said bulb contact, said electrical switch means including a manually operable switch element operatively threaded to said member for movement transversely to the longitudinal dimension of said cavity and bore, said switch element having a cam portion on one end operatively engageable with an upper edge portion of said battery whereby rotation of said element in one direction forces said battery downwardly thereby to disengage said battery from said bulb contact and in the other direction permits said battery to move upwardly under the force of said spring to engage said bulb contact.

2. The device of claim 1 wherein said chimney is at least partially transparent.

3. The device of claim 1 wherein said means further includes an internally threaded nut member secured within an opening in said bulb and switch-retaining member, said switch element being threaded into said nut member, the threaded portion of said nut member being longer than the threaded portion of said switch element, said nut member being provided with a stop adjacent to the outer end thereof engageable by the threads of said switch element which prevents said switch element from being unthreaded from said nut member, said switch element further having an abutment thereon spaced outwardly from the threaded portion thereof which is selectively engageable with the end of said nut member to limit the inward movement of said switch element, and said cam portion being conically shaped.

4. The device of claim 3 wherein said bulb and switch-retaining member is threaded to said base and said chimney is threaded to said member.

5. The device of claim 3 wherein said stop includes displaced material projecting radially inwardly of said nut member.

6. A lamp device comprising body means having a battery-receiving cavity therein closed at one end and open at the other end, an electrical device having an electrical contact, said device being secured to said body means within said open end and with said contact disposed within said cavity, a manually operable switch element operatively threaded to said body means for transverse movement relative to said cavity, a battery within said cavity having an electrode juxtaposed and operatively engageable with said electrical contact, means yieldably urging said battery in a direction to engage said electrode with said contact, and said switch element having a cam portion on the end thereof which is engageable with an edge of said battery adjacent to said electrode whereby rotation of said switch element in a direction that moves said cam portion inwardly forces said battery against the urging of said yieldable means out of engagement with said contact and rotation in the opposite direction releases said battery such that said electrode engages said contact.

7. The lamp device of claim 6 including an internally threaded nut member secured within an opening in said body means, said switch element being threaded into said nut member, the threaded portion of said nut member being longer than the threaded portion of said switch element, said nut member being provided with a stop adjacent to the outer end thereof engageable by the threads of said switch element which prevents said switch element from being unthreaded from said nut member, said switch element further having an abutment thereon spaced outwardly from the threaded portion thereof which is selectively engageable with the end of said nut member to limit the inward movement of said switch element, and said cam portion being conically shaped.

8. The lamp device of claim 7 wherein said nut member is cylindrical and said opening in said body means is cylindrical and of stepped diameter, said nut member fitting into the larger diameter portion of said opening and abutting against the shoulder formed between the two diameters of said opening.

9. The lamp device of claim 7 wherein said device is a bulb, a base provided with said contact and a second encircling contact, and means including said yieldable means providing a conductive path from said second contact to the opposite end of said battery.

10. The lamp device of claim 9 including a chimney removably secured to said body means in encircling relation to said bulb.

11. The lamp device of claim 7 wherein said cam portion is conical, said body means being of metal, said device having a second contact which conductively engages the metal of said body means.

12. The lamp device of claim 9 wherein said base means and chimney are of plastic, and said conductive path means includes a coating of metal on the wall of said cavity.

13. The lamp device of claim 12 wherein said base means is electroplated.

* * * * *